United States Patent [19]

Pritchett et al.

[11] 4,249,080

[45] Feb. 3, 1981

[54] JAM-SENSING SYSTEM AND APPARATUS

[75] Inventors: Wayne W. Pritchett, Newtown; Henry Bleggi, Fairfield, both of Conn.

[73] Assignee: Pitney Bowes Inc., Stamford, Conn.

[21] Appl. No.: 8,825

[22] Filed: Feb. 2, 1979

[51] Int. Cl.[3] ..... B65H 7/00

[52] U.S. Cl. ..... 250/557; 271/259; 340/675

[58] Field of Search ..... 250/557, 560, 223 R; 198/460, 502, 856; 271/259, 258; 340/674, 675

[56] References Cited

U.S. PATENT DOCUMENTS 3,778,629 12/1973 Terryn ..... 250/557

*Primary Examiner*—David C. Nelms
*Assistant Examiner*—Darwin R. Hostetter
*Attorney, Agent, or Firm*—Peter Vrahotes; William D. Soltow, Jr.; Albert W. Scribner

[57] ABSTRACT

A system for continuously transporting individual articles or a succession of uniformly-spaced articles on a moving conveyor surface through one or more work stations and for providing a warning signal when the normal location of any one of said articles changes relative to said conveyor surface by more than a predetermined permissible distance at a predetermined work station where such changes in spacing are most objectionable or dangerous. The system comprises a pulse-supplying means or machine clock for supplying pulses having a variable frequency proportional to the rate of movement of the conveyor surface, a delay means for providing a conveyor displacement signal when said conveyor surface has moved a predetermined distance and sensing means activated by each of said articles as they travel said predetermined distance to provide an article travel time signal. The system comprises means for comparing the timing difference, if any, between the conveyor travel time signal and the article travel time signal and for providing a warning signal when said signal times vary by more than a variable predetermined amount. According to another embodiment, the present system provides gap detecting means for comparing the web travel signals with the article travel signals for each of the succession of articles to detect the presence of spacing between articles in a particular work station and provide an alternative warning signal which, like the first warning signal, can be used as desired, such as to deactivate the particular work station, or stop the conveyor, or sound an alarm.

12 Claims, 7 Drawing Figures

JAM-SENSING SYSTEM AND APPARATUS

BACKGROUND OF THE INVENTION

The present invention relates to an automatic detection system for use in materials-conveyance systems in which a series of items are fed onto a moving surface at uniform intervals and conveyed on said moving surface for individual treatment in one or more stations, the detection system being concerned with automatically-sensing changes in the normal conveyance time for each of said items and producing a signal when predetermined abnormal changes occur in said normal conveyance time.

Primarily, the present invention relates to a paper handling machine, such as an electrostatic copying machine in which a succession of paper copy sheets are moved individually and in spaced relation against a moving continuous photoconductor web and through a series of work stations including a transfer station and a heat-treatment or fuser station in which the toner images transferred to each copy sheet are heated to an elevated temperature to fuse the toner powder to the copy sheet as the copy sheet passes therethrough.

As can be readily understood, a fire hazard is created if one of the paper sheets becomes trapped or lodged within the fuser station since the heater remains energized while the copy sheet is in the fuser station. Unless detected very quickly, successive copy sheets continue to be moved into the fuser station, resulting in a jam, and possible ignition of said copy sheets.

In realization of this problem, prior-known electrostatic copying machines have been provided with jam-detection systems which use photocells to sense the movement of articles on a conveyor surface and to load a shift register to provide a signal when the article should have moved a predetermined distance. The clock pulses to the shift register originate with a clock pulse generator which provides a series of pulses of uniform frequency independently of the rate of movement of the conveyor surface. The signal from the stage register and signals from a number of bistable devices or gates and associated photocells cooperate to deactivate the copying machine if such time period exceeds a predetermined time lapse during which the sheet would normally pass through the various stations of the machine. Thereafter, the operator must open the machine to clear any jammed paper from the fuser station and reset the machine for re-operation. Reference is made to U.S. Pat. No. 3,778,629.

While such prior-known systems are effective for their intended purpose, they have certain disadvantages. The procedure of opening the machine and clearing any trapped paper from the fuser station is time-consuming and frequently requires a trained technician or operator. In some instances, the machine must be left idle and the copying procedure left incompleted until such a trained person can attend to the clearing operation. This difficulty cannot be avoided whether a true jam has occurred or whether the machine has sensed a jam where no jam exists, in fact. This latter situation can occur in certain cases, such as where a voltage change may cause the speed of the conveyor surface to vary from normal, or where the paper movement may be hindered for an instant due to slippage, or other cause. In such cases, there is no trapping of the paper within the fuser and no fire hazard. However, the logic system of the machine senses an irregularity in the time delay for the paper feed and deactivates the machine so that it cannot be re-operated without opening the fuser station and resetting the machine.

Prior-known systems also employ photocells to detect the movement of each copy sheet along its intended path. Such photocells are subject to erroneous activation by paper scraps or other foreign matter which may collect on the conveyor belt.

Prior-known systems are also in use which are based upon the detection of spacing or gaps between articles being conveyed. Such systems are unsatisfactory because they are too slow to react to certain problems, such as where the leading edge of a sheet becomes jammed. The machine logic cannot signal such a jam until after a period of time exceeding the period during which the entrance switch would normally be energized.

SUMMARY OF THE INVENTION

The present invention comprises a method and apparatus employing a conveyor surface which moves along a predetermined path at a normally-uniform speed to receive and convey a single article or a series of normally-uniformly-spaced articles through one or more work stations, and for detecting variations in the position of each said article due to the occurrence of relative movement between any said article and said conveyor surface, said conveyor surface being the activator for a pulse-producing means to provide a variable speed clock system which is also adapted to detect the position of any misaligned article relative to a particular work station and relative to the next article being conveyed therebehind. The present method and apparatus includes means for detecting predetermined uniform lengths of said conveyor surface, means for providing a uniform number of conveyor surface-movement pulses for each of said uniform lengths, said pulses having a variable frequency proportional to the rate of movement of the conveyor surface, and position indicating means for providing a signal when said conveyor surface has moved a distance equal to each of said predetermined lengths. The present method and apparatus also includes article sensing means for detecting the pulse period required for each of said articles to move a distance equal to said predetermined length, for generating a series of article-movement pulses representative thereof, and for comparing said article movement pulses with said conveying surface-movement pulses over said distance to provide a warning signal when said pulses differ by more than a variable predetermined number.

Depending upon the nature of the conveying system involved, said warning signal may be used to automatically stop the conveyor surface movement or to deactivate a particular work station However, according to the preferred embodiment of the present invention, the warning signal is associated with a station detection system which compares said warning signal with a signal from the station indicating means, indicating that the length of the conveyor surface carrying the misaligned or jammed article is in the area of a particular work station and only provides a jam signal to deactivate that work station or cause other result when said signals are both present.

According to yet another embodiment of this invention, a gap detection system is combined with the position detection system discussed supra, to provide a second or alternate jam signal to deactivate the work station or conveyor if a gap is not detected by the article sensing means during the pulse period required for a uniform length of the conveyor surface to pass through the work station, said gap being represented by a resetting of the article-movement pulse counter during the time period required for each length f of conveyor surface to pass through the uniform length of the work station.

As discussed supra, the essential novelty of the present invention resides in a timing system for detecting variations in the normal position of an article or a succession of normally uniformly-spaced articles being conveyed on a moving surface, the timing means being directly associated with the rate of movement of the moving surface so as to be variable therewith and also being directly associated with means for sensing the position of the articles relative to a work station and therefore relative to each other. An advantage of the present invention resides in the great flexibility of the present timing system whereby it can be preset to permit predetermined minor variations in the normal position of an article or in the normal spacing between the articles being conveyed without causing shut down of the apparatus, and it can be combined with one or more check-off systems in order to further limit shut-down of the apparatus to situations where the spacing variation occurs on a length of the conveyor surface which is within a particular work station and/or to situations where such spacing variation is so extreme that one conveyed article catches up with the one in front of it.

BRIEF DESCRIPTION OF THE DRAWING

The objects and advantages of the present invention will be apparent to those skilled in the art in the light of the present disclosure including the drawing in which.

DETAILED DESCRIPTION OF THE DRAWING

Figure 1:
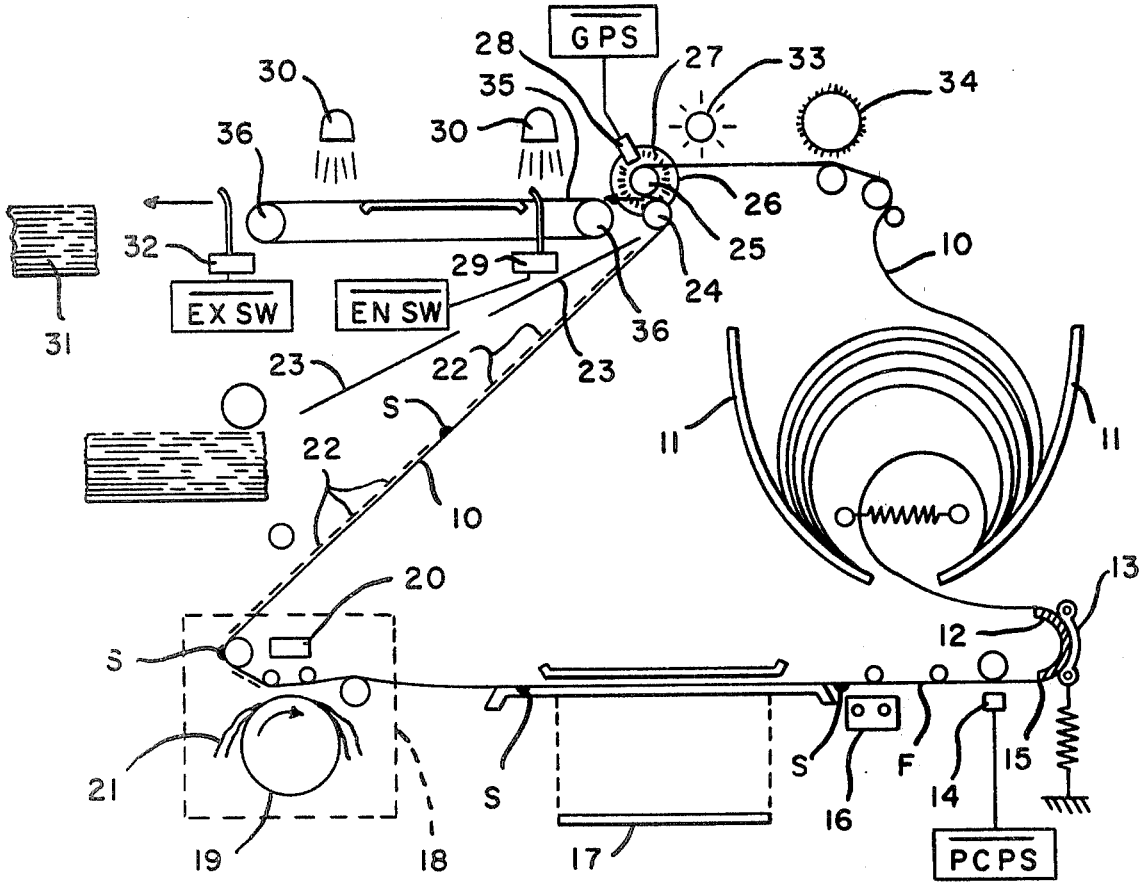
FIG. 1 is a diagrammatic cross-sectional view of a portion of an electrostatic copying machine illustrating the path of a continuous photoresponsive master web through a series of work stations and further illustrating the web movement timing system of the present invention.

FIG. 1 illustrates the use of the novel position and/or gap sensor system of the present invention in an electrostatic copying apparatus of the type illustrated by U.S. Pat. No. 4,051,986, the disclosure of which is incorporated herein by reference.

As shown in FIG. 1, a continuous, photoresponsive master web 10, consisting of a multiplicity of folds f of uniform length, i.e., sixteen (16) inch lengths, is dispensed from container hopper 11, passes between guide element 12 and brake element 13 and is drawn into a web length detector station and across a photoelectric sensor 14 with the photoresponsive surface 15 of the web 10 in close proximity to the sensor 14. The leading edge of each fold f of the web is provided with a reflective spot s which is sensed by senor 14 to provide an active low signal or photoconductor pulse ($\overline{PCPS}$) representative of the start of each new web length thereby. Thereafter the web moves into a charging station and over a device 16 which produces a potential of negative 500 volts over the entire photoreceptive surface 15.

After being charged, the web enters the exposure station where each web length is exposed to the flash reflection 17 of a strobe-illuminated original sheet. If multiple copies of the same original are desired, the required number of successive web lengths are exposed to said original. The electrostatic charges are dissipated and reduced or removed from the exposed areas of the photoreceptive surface 15, in proportion to the degrees of reflected illumination received from the different areas of the original sheet.

Thereafter the moving exposed web enters the development station 18 into close proximity with the application roller 19 and under magnet 20. The developer composition 21 comprises a mixture of fine magnetic particles and a minor amount of heat-fusible toner powder which is carried by the magnetic particles but which has a greater affinity for the electrostatic charges remaining on the photoreceptive surface 15. Application roller 19 is charged with a negative voltage of 150 volts d.c. to help suppress background by making the roller 19 more attractive to the developer mixture 21 than is the residual charge remaining on the exposed background areas of the web. The roller 19 is magnetized by magnet 20 so that it attracts the magnetic developer mixture 21 to its surface so that the mixture can be carried by the roller 19 and drawn into proximity with the charged areas of surface 15 of the web 10 which have a potential greater than −150 volts d.c. The toner particles separate from the magnetic carrier particles and transfer to the charged areas of the surface 15 in amounts proportional to the strength of the electrostatic charges remaining on surface 15 to form toner images 22 corresponding to the images on the original sheet.

The toner-imaged web then continues its movement to the transfer station where the toner-imaged surface of the web is brought into contact with one or a succession of individually fed, uniformly-spaced copy sheets 23 which are compressed between idler roller 24 and web transport roller 25 having different polarities which induce transfer of the toner images 22 to the surface of each sheet 23. Web transport roller 25 has associated therewith a slotted grid wheel 26 provided with radial slots 27 and a photo-sensitive slot sensor 28 or grid pulse sensor (GPS) which emits an electric pulse or signal for each slot 27 as a measure of the length of web passing over roller 25.

The toner-imaged copy sheets pass into a heat-fusion zone comprising an entrance switch 29, radiant heat lamps 30 which cause the toner composition to fuse to the copy paper to form the final copies 31, and an exit switch 32. The continuous master web passes from the transfer station, through a cleaning station including an exposure lamp 33 and a cleaning brush 34 and back into folded condition within the master container hopper 11 for reuse, whereas the toner-imaged copy sheets continue their movement on conveyor belt 35 which moves at the same speed as web 10 and represents an extension of the conveyor system.

Figure 2:
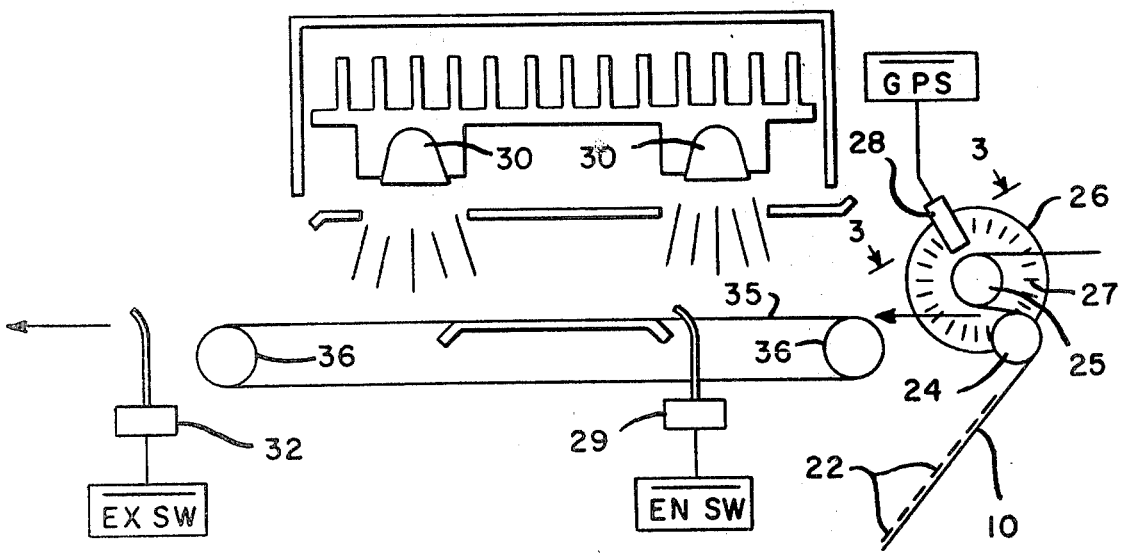
FIG. 2 is an enlarged view of the fuser work station area of the machine of FIG. 1, illustrating the timing pulse generator and article-sensing switches in greater detail.
Figure 3:
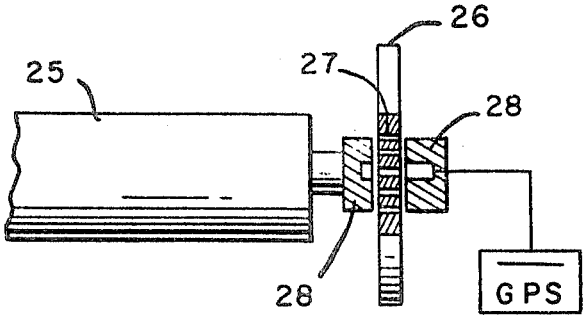
FIG. 3 is a view taken along the line 3—3 of FIG. 2.
Figure 4:
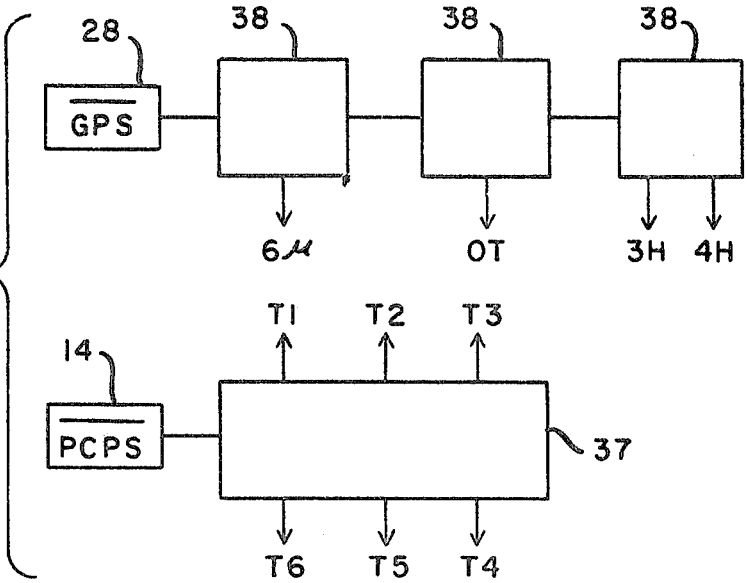
FIG. 4 is schematic view of the circuitry associated with the timing pulse generator to develop various timing signals representative of the rate of movement of the conveyor surface and its location along a predetermined path.

As illustrated more clearly by FIGS. 2 and 3, the present position-sensing and gap-sensing system involves the use of a slotted grid wheel 26 which is attached to the web transport roller 25 for relative rotation therewith, i.e., any variation in the speed of the web is imparted directly to the grid wheel. The wheel 26 is provided with a number of uniformly-spaced transverse radial slots 27, and is associated with a photoelectric slot-sensor 28 which projects an infrared light beam through the slots 27 of the wheel and provides an electric pulse each time the beam is interrupted. Thus a succession of pulses is provided as the web turns the roller 25 and wheel 26, the frequency of the pulses increasing with the speed of the wheel 26, but the number of pulses for any given length of the web remaining constant. As illustrated by FIG. 4, the grid pulse signals or GPS from sensor 28 are fed to a pulse counter 38 to provide signals which indicate the rate of movement of the web and the exact portion of each 16-inch web length which has passed the roller 25 or has passed any given work area, such as the transfer station of the apparatus, the GPS signals being reset by the photoconductor sheet length sensor 14 to provide a series of uniform pulse numbers T representative of each 16-inch fold length f of the web or each group of two, three or more successive fold lengths f depending upon the number of duplicate copies being produced. Each successive group of said pulse numbers T provides a signal representative thereof, i.e., $T_1$, $T_2$, $T_3$ . . . $T_5$, $T_6$, whereby when said pulse numbers are counted from a given starting point, such as at the entrance of the charging station, to develop the T1 signal, the successive T signals indicate the travel of the web lengths f predetermined known distances along the path of the web so that a T4 signal, for instance, may indicate that the starting web length f is entering the transfer station, activating the copy paper feed roll, and a T5 signal may indicate that the copy sheet from the transfer station is about to enter the fusing station, as illustrated by the pulse diagram of FIG. 6.

FIG. 4 illustrates the electrical circuitry with which the grid pulse sensor GPS 28 and the photoconductor sheet length sensor 14 or PCPS signal are associated. The object of such circuitry is to provide web position signals indicative of the presence of each predetermined length or fold f of the master web in the area of the critical work station, i.e., the T5 and T6 signals which indicate the presence of imaged copy sheets corresponding to each fold f in the area of the fuser station, and to provide web movement signals indicative of the movement of each said copy sheet through said work station so that said signals can be compared with a gap signal provided by the movement of the spaced copy sheets past the entrance switch of the fuser station. Thus the movement of the web 10, including fuser conveyor 35, is compared to the movement of the copy sheets into the fuser station, and the absence of a gap between sheets entering the fuser station will permit the web movement signals to activate a jam signal. The position signals or T signals are provided by a counter 37 which is connected to the PCPS sensor 14 which is activated by the reflective spot present at the leading edge of each fold length f of the web 10, T1, T2 . . . T5, T6, representing the movement of each length of continuous web 10 correspondng to each fold length f of web 10 through the work stations of the machine and T5, for example, indicating the movement of a length of the conveyor corresponding to the first fold length f of web 10 to the fifth work station, for example the fuser. The web movement signals are provided by the GPS sensor 28 in conjunction with counter 38 which counts and groups grid pulses and provides recurring different timing signals which are acting in common at least once during the movement of the conveyor through each station, including the fuser station. In this manner, the web movement signals can be compared with the position signal for any station, such as T5 and T6, and if no gap signal is given during such position signal a jam signal is given to deactivate the work station.

As shown in FIG. 4, the GPS grid pulse sensor 28 sends grid pulses to the counter 38 which emits timing signals 6u, OT, 3H and 4H. Other timing signals are also provided for other machine functions but these are not illustrated because they are not necessary to the machine features specifically covered by the present invention. The 6u signal is active for every one out of eight grid pulses. The OT signal is active for eight out of every sixty-four grid pulse periods. The H signal is active for sixty-four out of every 512 grid pulses, 3H and 4H representing successive active H periods, 4H becoming active when 3H becomes inactive. In the present electrostatic copying machines, if 2 or 3 copies of an original are desired, the reflective spot sensor or PCPS 14 is connected to the T counter to multiply the time periods T so that while the necessary 2 or 3 fold lengths f of the web pass through each work station, said work station remains active for the required time period. For normal single copy, T1 will be active for approximately 414 grid pulses and is deactivated as T2 becomes active for approximately 414 grid pulses, etc.

The system described to this point represents a system for providing signals representative of the movement of uniform lengths of a conveyor surface comprising one or more webs or belts through work stations and from one station to the next. The present invention combines this system of conveyor movement sensing with a second system of article movement sensing whereby articles can be fed at uniform intervals to predetermined spaced sections of said conveyor surface and any relative movement between the conveyor surface or web and the articles supported thereon for uniform movement therewith will be detected, predetermined minor variations can be permitted, and/or variations which retain a gap or space between articles can be permitted.

Referring to FIGS. 1 and 2 of the drawing, the article sensing means is illustrated in association with the fusing station of an electrostatic copying machine because it is such station which presents the greatest hazard or danger in the event conveyed articles, namely copy sheets, becoming jammed or trapped therein.

Thus an entrance switch 29 and an exit switch 32 are provided in the fusing station at opposed ends of the conveyor belt 35 which is provided with a central space or slot through which the sensor blades of switches 29 and 32 project. Belt 35 is driven by rollers 36 and the web 10 and the belt 35 move at the same speed since the belt rollers are associated with the web roller 24 by means of a chain drive.

Figure 5:
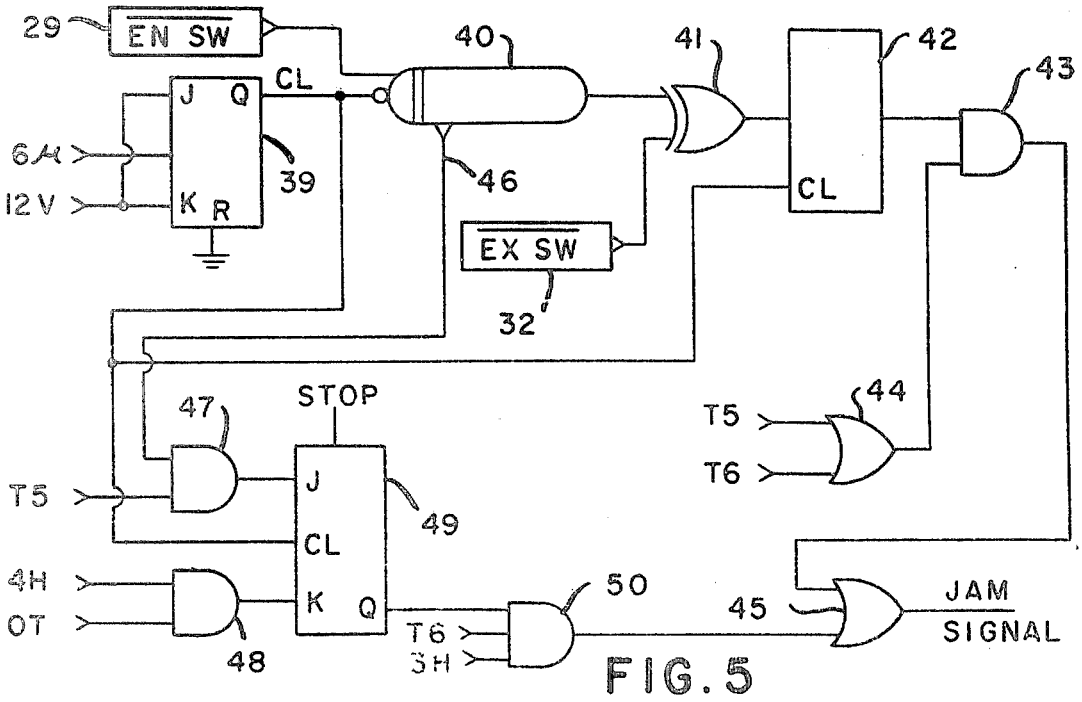
FIG. 5 is a schematic view of the circuitry associated with the timing pulse generator and article-sensing means of FIG. 1.

FIG. 5 illustrates the circuitry which provides a correlation between the web movement sensing system and the article movement sensing system in the area of the preselected work station, i.e., as the article is entering, in or leaving said station. Such correlation permits the detection of differences between the web or belt travel time and the article travel time through the work station, permits minor differences to be allowed, detects the presence of gaps or spaces between successive articles being conveyed through the work station and provides a jam signal to deactivate the work station, i.e., shut off the power to the heating lamps, when adequate gaps or spaces are no longer present.

FIG. 5 illustrates an 18 stage static shift register 40 or delay which is loaded by the signal from clock register 39 in association with the $\overline{\text{ENSW}}$ signal. The clock register 39 receives the 6u grid pulse signal and a 12-volt power input and halves the 6u signal to provide clock pulse signals, (CL), one for every sixteen grid pulses, to the 18 stage register 40 only during the period that the $\overline{\text{ENSW}}$ or entrance switch 29 is depressed. Thus, when an article enters the work station, it depresses the entrance switch and permits the 18 stage register 40 to count grid pulses until it reaches a predetermined number representative of the movement of the conveyor belt 35 (or photoconductive web 10) a distance equal to the distance between the entrance switch 29 and the exit switch 32. Variations in the speed of movement of web 10 will simultaneously vary the frequency of the grid pulse signals received from the web sensor 28 to insure uniformity at all times whereas the use of a pulse-providing means which is independent of the movement of the web will result in timing errors if the movement of the web or belt varies due to power drops or other causes. Thus the 18 stage delay 40 provides a signal to an exclusive-OR gate 41 at the proper grid pulse count at which the article should activate the exit switch 32. The exclusive-OR gate 41 is also associated with the active low output of the $\overline{\text{EXSW}}$ or exit switch 32, and the output of the exclusive-OR gate 41 is active only when the signal from the 18 stage register 40 is different from the $\overline{\text{EXSW}}$ signal. Thus initially both signals to the gate 41 are O but if either signal becomes active before the other, the exclusive-OR gate 41 provides an input signal to a 2 stage register 42 or flip-flop which times said signal and becomes active if said input signal exceeds a preset number of clock periods. The exclusive-OR gate 41 becomes inactive when the second input signal is received, normally from the depression and activation of the exit switch 32 since any delay is normally caused by a slippage or momentary jamming of the article being conveyed, i.e., copy paper.

The 2 stage register 42 or flip-flop is designed to become active after two clock periods, i.e., 32 grid pulses, whereby it provides a warning signal to an AND gate 43 which is associated with the output of an OR gate 44 supplied with T5 and T6 signals. The output of the AND gate 43 becomes active when the active warning signal is received from the 2 stage register 42 at the same time as T5 and/or T6 is active, i.e., if the delay signalled by the 2 stage register 42 occurs while the grid pulse system or web movement sensing system indicates that an article is in the area of the work station, i.e., either entering, in or exiting the work station. In such case the AND gate 43 becomes active and emits a jam signal to deactivate the work station or cause any other desired result.

In the system illustrated by FIG. 5 the jam signal output of the AND gate 43 is connected to an OR gate 45 which is also connected to the output of AND gate 50 of a gap detector system so that the ultimate jam signal is the output of the OR gate 45. The OR gate 45 is inactive until either or both of the inputs thereto are active, i.e., until an active sheet delay signal is given by AND gate 43 while the gap detector signal is normally inactive or until the gap detector signal becomes active while the sheet delay signal from AND gate 43 remains normally inactive.

Figure 6:
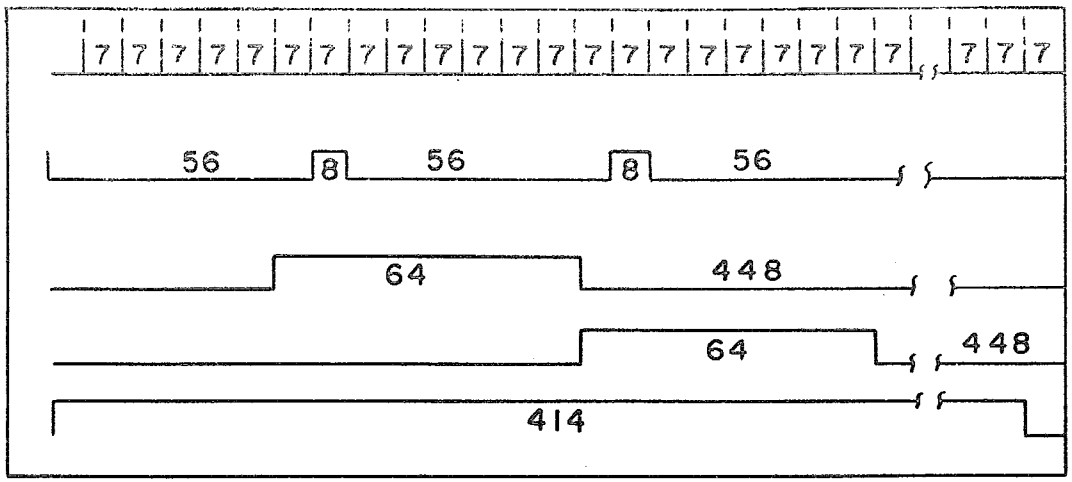
FIGS. 6 and 7 are pulse diagrams illustrating the various conditions of the various signals associated with the circuitry of FIGS. 4 and 5 for single copy and triple copy operation.

The gap detector system of FIG. 5 consists of AND gate 47 and 48, flip-flop 49 which has a normally active output connected to AND gate 50, the output of which is connected to the jam OR gate 45. AND gate 47 is connected to the gap signal 46 of 18 stage register 40 and to the T5 signal so that the output from AND gate 47 becomes active each time the 18 stage register 40 senses a gap between sheets while T5 is active, i.e., while the entrance switch 29 is activated, it causes the $\overline{\text{ENSW}}$ signal to become active, starting the loading of the register 40 with zeros until the entrance switch is deactivated by the passage of the sheet thereby, which deactivation indicates the presence of a gap between sheets being conveyed and activates the gap signal 46 which is connected to the first stage of the register 40. The AND gate 48 is connected to the 4H and OT signals which are both active for common periods during each clock period during which T5 is active, as shown by FIG. 6, so that the output of the flip-flop 49 to the AND gate 50 is always active during such period unless a gap is detected and the gap signal 46 becomes active. If a gap is detected, the output of the flip-flop 49 becomes inactive and the output of the AND gate 50 is also inactive to the OR gate 45 so that no jam signal is caused by the gap detector system.

Conversely, if no gap is detected, reset signal 46 remains inactive and the output of the flip-flop 49 remains active, the output of the AND gate 50 becomes active when the T6 and 3H signals are active, which occurs during the clock period during which T5 as active as shown by FIG. 6, and the OR gate 49 is activated to signal a jam.

Figure 7:
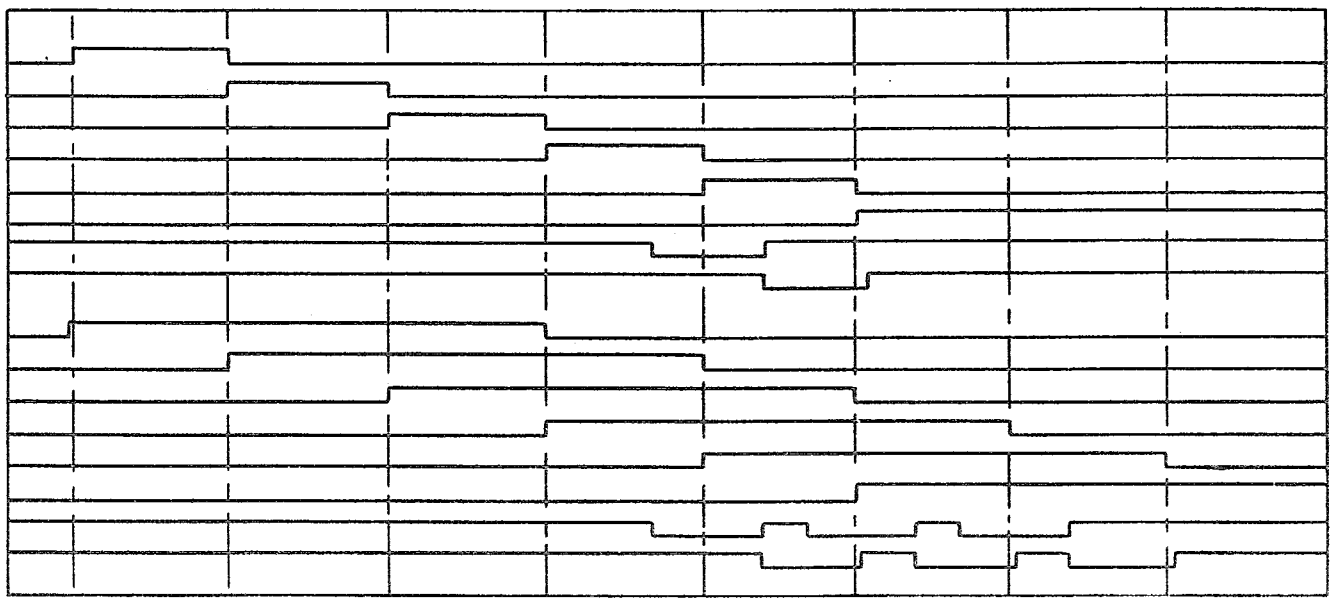

The pulse diagram of FIG. 6 illustrates the correlation between the signals generated by the GPS sensor 28 and counters 38 and each web position T signal while the pulse diagram of FIG. 7 illustrates the correlation between the various web position T signals and the $\overline{\text{ENSW}}$ and $\overline{\text{EXSW}}$ signals for both the single copy and triple copy modes of the present apparatus. As can be seen from FIG. 6, the OT and 4H signals are active in common during each web position T signal to activate the AND gate 48 of FIG. 5. Also the 3H signal is active during each T6 period to activate the AND gate 50. As can be seen from FIG. 7, the fuser entrance switch (ENSW) is activated just prior to each T5 active period and T5 remains active for the number of PCPS periods corresponding to the number of copies being made.

As is clear from the present disclosure, the present sensing system provides a means for detecting relative movement between articles being conveyed and the conveyor surface on which they are carried, i.e., the stage register 40 and exclusive OR gate 41, means for permitting predetermined minor variations in relative movement, i.e., 2 stage register 42, means for permitting variations in relative movement except in predetermined work stations, i.e., OR gate 44 and AND gate 43, and means for detecting the presence of gaps between articles being conveyed into a predetermined work station, i.e., gap signal 46 and AND gate 47. It should be understood that while the combined gap detection system and article movement sensing system represents a preferred embodiment of the present invention with respect to the use of invention on office copying machines, the article movement sensing system may be used alone in connection with conveyor systems in which gap detection is not required. Thus the system illustrated by FIG. 5 provides a jam signal output from OR gate 45 if no gap is detected or if the exit switch of the critical work station is not activated at the proper time. The combined system of FIG. 5 is preferred for certain embodiments where the articles being conveyed are physically capable of overlapping with each other, such as paper sheets, since no relative movement will be detected to long as the first sheet exits at the proper time. In such case the gap detector is essential to the activation of the jam signal. However, in cases where the articles being conveyed are not physically capable of overlapping, the jam detection portion of the circuit of FIG. 5 may not be necessary and may be omitted. The present invention provides the advantage of correlating the rate of supply and movement of the articles being conveyed with the rate of movement of the conveying surface with respect to a critical work station, thereby permitting the rate of movement of the conveying surface to be varied intentionally or due to voltage changes without resulting in a jam signal where no jam exists, in fact. Thus the present system can be used in assembly line conveyor systems employing a manually-operable variable speed conveyor surface automatically varying the timing by which articles are fed onto the conveying surface and the timing by which articles are treated in one or more work stations.

Variations and modifications will be apparent to those skilled in the art within the scope of the present claims.

We claim:

1. An apparatus for conveying one or more articles on a conveyor surface along a predetermined path and for providing a signal indicative of any variation in the location of each said article relative to said conveyor surface, comprising a conveyor surface adapted to support one or a succession of spaced articles for movement along said predetermined path, means for moving said conveyor surface along said path, means for supplying one or a succession of spaced articles to said moving surface, pulse-supplying means associated with said conveyor surface to provide a series of pulses having a variable frequency proportional to the rate of movement of said conveyor surface, pulse storage means associated with said pulse-supplying means for providing a delay signal when a predetermined number of pulses are received from said pulse-supplying means representative of the movement of said conveyor surface a distance equivalent to a predetermined length of said path, entrance sensing means adapted to detect the movement of each article on said conveyor surface into said predetermined length of said path and to cause said pulse storage means to begin storing the pulses received from said pulse-supplying means until each said article passes said entrance sensing means, exit sensing means adapted to sense the movement of each article present on said conveyor surface out of said predetermined length of said path and to provide an exit signal representative thereof, and comparing means associated with said pulse storage means and with said exit sensing means for providing a warning signal when the delay signal from the pulse storage means differs from the exit signal from the exit sensing means.

2. An apparatus according to claim 1 in which said warning signal is introduced to a timing means which is associated with said pulse supplying means and said comparing means, said timing means being adapted to provide a second warning signal only when said first warning signal is active for more than a predetermined number of pulses received from said pulse supplying means.

3. An apparatus according to claim 2 which further comprises means for sensing predetermined uniform lengths of said conveyor surface, means for providing a web position signal when each said web length is within said predetermined length of said path, and means for comparing said web position signal with said second warning signal to provide a jam signal only when said signals are active at the same time.

4. An apparatus according to claim 1 which further comprises means for detecting the presence of a gap between successive articles being conveyed into said predetermined length of said path and for producing a gap signal representative thereof, and means for producing a jam signal when no such gap signal is present.

5. An apparatus according to claim 4 which further comprises means for sensing predetermined uniform lengths of said conveyor surface, means for providing a web position signal when each said web length is within said predetermined length of said path and means for providing a jam signal only when said gap signal is not produced while said web position signal is active.

6. An apparatus according to claim 5 which further comprises means associated with said pulse-supplying means for providing a web movement signal indicative of the movement of said conveyor surface through said predetermined length of said path and means for preventing said jam signal unless said web movement signal is active.

7. An apparatus according to claim 1 in which said pulse-supplying means comprises a light sensor in association with a wheel provided with a multiplicity of evenly-spaced radial slots, said wheel being associated with the means for moving the conveyor surface so that its rate of revolution varies in proportion to any change in the rate of movement of the conveyor surface.

8. A method for conveying one or more articles on a moving surface along a predetermined path and for detecting any variation in the location of each said article relative to said moving surface, comprising supplying one or more articles to a moving surface for movement along said predetermined path, moving said surface along said path, sensing the rate of movement of said surface to provide a series of pulses having a variable frequency proportional to the rate of movement of said surface, counting said pulses until a predetermined number of pulses are received representative of the movement of said surface a distance equivalent to a predetermined length of said path to provide a web travel count, sensing the entry of said each article on said surface into said predetermined length of said path and beginning the count of said pulses, sensing the exit of each said article out of said predetermined length of said path and stopping said count of said pulses to provide an article travel count, and comparing said article travel count with said travel count to detect any relative movement between any said article and said moving surface.

9. The method according to claim 8 in which a jam signal is given only if the article travel count and the web travel count differ by more than a predetermined number of pulses.

10. The method according to claim 8 in which said moving surface is divided into uniform successive lengths, each of said lengths is sensed to provide a succession of station signals having a variable frequency proportional to the rate of movement of said moving surface, each said station signal being representative of the movement of the said surface through a different predetermined work station along the length of said path, and providing a jam signal if relative movement is detected between said article and said moving surface only if the station signal is active with respect to said predetermined length of said path.

11. The method according to claim 10 in which a jam signal is given if the entry of the next article into the predetermined length of said path is not sensed while the section of the moving web which supported the article in front thereof is present in said predetermined length of said path.

12. The method according to claim 11 in which said jam signal is only given if the section of the moving web which supported said front article has moved a predetermined distance along said predetermined length of said path.

* * * * *